US012359273B2

(12) United States Patent
Xue et al.

(10) Patent No.: US 12,359,273 B2
(45) Date of Patent: Jul. 15, 2025

(54) 980MPA GRADE COLD-ROLL STEEL SHEETS WITH HIGH HOLE EXPANSION RATE AND HIGHER PERCENTAGE ELONGATION AND MANUFACTURING METHOD THEREFOR

(71) Applicant: BAOSHAN IRON & STEEL CO., LTD., Shanghai (CN)

(72) Inventors: Peng Xue, Shanghai (CN); Xiaodong Zhu, Shanghai (CN); Wei Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 881 days.

(21) Appl. No.: 17/296,303

(22) PCT Filed: Nov. 29, 2019

(86) PCT No.: PCT/CN2019/121868

§ 371 (c)(1),
(2) Date: May 24, 2021

(87) PCT Pub. No.: WO2020/108597

PCT Pub. Date: Jun. 4, 2020

(65) Prior Publication Data

US 2022/0010401 A1 Jan. 13, 2022

(30) Foreign Application Priority Data

Nov. 29, 2018 (CN) ..... 201811444049.0

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/28*** | (2006.01) |
| ***C22C 38/38*** | (2006.01) |

(52) U.S. Cl.

CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/22* (2013.01); *C22C 38/28* (2013.01); *C22C 38/38* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 7,371,294 | B2 | 5/2008 | Miura et al. |
| 2013/0153096 | A1 | 6/2013 | Hamada et al. |
| 2015/0041024 | A1 | 2/2015 | Schulz et al. |

FOREIGN PATENT DOCUMENTS

| | | | | | |
|---|---|---|---|---|---|
| CN | 103492599 | A | | 1/2014 | |
| CN | 105734410 | A | * | 7/2016 | ..... C21D 8/02 |
| CN | 105874086 | A | | 8/2016 | |
| CN | 108193139 | A | | 6/2018 | |
| CN | 109576579 | A | | 4/2019 | |
| EP | 2182080 | A1 | | 5/2010 | |
| JP | 2004-068050 | A | | 3/2004 | |
| JP | 2006-219741 | A | | 8/2006 | |
| JP | 2010-526935 | A | | 8/2010 | |
| JP | 2011-132602 | A | | 7/2011 | |
| KR | 10-2016-0078570 | A | | 7/2016 | |
| WO | 2015/162849 | A | | 10/2015 | |
| WO | 2016/152162 | A | | 9/2016 | |
| WO | 2018/030501 | A1 | | 2/2018 | |
| WO | 2018/193787 | A | | 10/2018 | |

OTHER PUBLICATIONS

Supplementary EP Search Report for EP 19 88 9858 dated Nov. 17, 2021.

JP Office Action dated May 10, 2022 for companion JP application No. 2021-531024.

International Search Report mailed on Feb. 26, 2020 for PCT Patent Application No. PCT/CN2019/121868.

Written Opinion mailed on Feb. 26, 2020 for PCT Patent Application No. PCT/CN2019/121868.

* cited by examiner

*Primary Examiner* — Anthony M Liang

(74) *Attorney, Agent, or Firm* — Lei Fang, Esq.; Smith Tempel Blaha LLC

(57) ABSTRACT

Disclosed is a 980 MPa grade cold-roll steel sheets with high hole expansion rate and higher percentage elongation, and manufacturing method thereof. The mass percents of chemical components in the steel sheet are: C: 0.08%-0.12%, Si: 0.1%-1.0%, Mn: 1.9%-2.6%, Al: 0.01%-0.05%, Cr: 0.1-0.55%, Mo: 0.1-0.5%, Ti: 0.01-0.1%, the rest being Fe and other inevitable impurities. The steel plate has a yield strength >600 MPa, a tensile strength >980 MPa, a percentage elongation >11%, a hole expansion rate ≥45%, and a tensile strength up to 980 MPa grade; the microscopic structure is ferrite plus bainite plus martensite, with the volume fraction content of ferrite >10%, the volume fraction content of bainite >30%, and the volume fraction content of martensite >15%; the microscopic structure further comprises nanoscale precipitates in uniform dispersion distribution, the average size of precipitates being less than 20 nm.

16 Claims, No Drawings

980MPA GRADE COLD-ROLL STEEL SHEETS WITH HIGH HOLE EXPANSION RATE AND HIGHER PERCENTAGE ELONGATION AND MANUFACTURING METHOD THEREFOR

CROSS-REFERENCE TO RELATED APPLICATIONS

This application is a 371 U.S. National Phase of PCT International Application No. PCT/CN2019/121868 filed on Nov. 29, 2019, which claims benefit and priority to Chinese patent application no. CN 201811444049.0 filed on Nov. 29, 2018, the contents of both are incorporated by reference herein in their entries.

TECHNICAL FIELD

The present disclosure relates to a cold-rolled steel sheet and a manufacturing method thereof, in particular to a 980 MPa grade cold-rolled steel sheet with a high hole expansion rate and a higher elongation and a manufacturing method thereof.

BACKGROUND ART

As the global energy crisis and environmental problems are becoming more and more severe, energy conservation and safety have become the main direction of the development of the automobile manufacturing industry. High-strength steel has good mechanical properties and serviceability and is suitable for manufacture of structural parts.

In order to impart a high hole expansion rate to a traditional cold-rolled steel sheet, the common method is to enable the matrix to obtain a high proportion of bainite structure (generally a complex phase steel with a bainite content of more than 70%) by a process route of continuous annealing+medium temperature overaging, thereby reducing the strength variation of the structure and increasing the hole expansion rate. This type of steel sheet having a high hole expansion rate has inherent shortcomings: the high proportion of bainite structure can ensure a high hole expansion rate, but the elongation rate of the matrix with the high proportion of bainite structure is not high, and the processability of the material is reduced.

In addition, some other types of cold-rolled high-strength steel with a high hole expansion rate are as follows:

US Patent Publication No. US20180023155A1 discloses an ultra-high-strength cold-rolled steel sheet of a grade of 980 MPa or higher with an excellent elongation and an excellent hole expansion rate and a manufacturing method thereof, wherein C: 0.1-0.5%, Si: 0.8-4.0%, Mn: 1.0-4.0%, P: 0.015% or less, S: 0.005% or less, Al: 0-2%, N: 0.01% or less, Ti: 0.02-0.15%, and other optional elements that can be added. The final structure is required to contain ferrite phase, bainite phase and martensite phase, and it is required to contain 10-25% residual austenite phase. It's unique that addition of Si is relied upon to obtain residual austenite, thereby obtaining a better elongation and a better hole expansion rate, and the hole expansion rate of the 980 MPa grade can only reach 30% or higher.

Korean Patent Publication No. KR1858852B1 discloses an ultra-high-strength cold-rolled steel of a grade of 980 MPa or higher with a high elongation, high toughness and an excellent hole expansion rate and a manufacturing method thereof, wherein C: 0.06-0.2%, Si: 0.3-2.5%, Mn: 1.5-3.0%, Al: 0.01-0.2%, Mo: 0-0.2%, Ti: 0.01-0.05%, Ni: 0.01-3.0%, Sb: 0.02-0.05%, B: 0.0005-0.003%, N: 0.01% or less, and a balance of Fe and other unavoidable impurities. It's unique that by controlling the ratio of tempered martensite to martensite in a process and increasing the addition of Si, the final structure contains more than 20% residual austenite, and finally better comprehensive forming properties are obtained.

The above two applications both introduce the method of obtaining a better hole expansion rate by adding Si to obtain residual austenite, and both the applications rely on the addition of a high Si content.

At present, ultra-high-strength DP steel and QP steel have good strength and plasticity, but the hole expansion rate (approximately 20% to 35%) is far lower than that of traditional automotive soft steel. The hole expansion rate of CP steel is high, but its elongation is too low. Therefore, if a product having an elongation not lower than that of DP steel and an improved hole expansion rate is developed, it should have a broad application prospect.

SUMMARY OF INVENTION

An object of the present disclosure is to provide a 980 MPa grade cold-rolled steel sheet having a high hole expansion rate and a high elongation, and a manufacturing method thereof. The steel sheet has a yield strength of greater than 600 MPa, a tensile strength of greater than 980 MPa, an elongation of greater than 11%, and a porosity ≥45%. The steel sheet has a strength grade of 980 MPa. The final structure comprises more than 30% bainite to obtain the high hole expansion rate; the volume fraction of martensite is greater than 15% to ensure strength; and the remaining structure is more than 10% ferrite to ensure the high elongation. Nano-scale precipitates uniformly and dispersively distributed in the structure are obtained, so as to obtain high precipitation strengthening effect and reduce the strength difference between phases, thereby obtaining an excellent hole expansion rate.

To achieve the above object, the technical solution of the present disclosure is as follows:

The designed composition of the steel of the present disclosure is a compositional system mainly composed of C+Mn+Cr+Mo+Ti, wherein the coordinated design of C, Mn, Cr and Mo ensures that diffusion-type phase transformation—ferrite phase transformation occurs after hot rolling and coiling, resulting in a large number of interphase nano-precipitates; that the bainite C curve shifts to the left, so that the final bainite volume fraction is greater than 30%; and that certain hardenability is obtained, so that the martensite volume fraction in the final structure is greater than 15%.

Specifically, the 980 MPa grade cold-rolled steel sheet having a high hole expansion rate and a high elongation according to the present disclosure has a chemical composition based on mass percentage of: C: 0.08%-0.12%, Si: 0.1%-1.0%, Mn: 1.9%-2.6%, Al: 0.01%-0.05%, Cr: 0.1-0.55%, Mo: 0.1-0.5%, Ti: 0.01-0.1%, and a balance of Fe and other unavoidable impurities, wherein the following relationships are satisfied: $1.8 \geq 5\times[C]+0.4\times[Si]+0.1\times([Mn]+[Cr]+[Mo])^2 \geq 1.3$, $[Mo] \geq 3\times[Ti]$.

The microstructure of the cold-rolled steel sheet of the present disclosure is ferrite+bainite+martensite, plus nano-scale precipitates distributed uniformly and dispersedly (i.e., scattered all around), wherein bainite has a volume fraction of greater than 30%; martensite has a volume fraction of greater than 15%; and the precipitates have an average size of less than 20 nm. Generally, in the microstructure of the cold-rolled steel sheet of the present disclosure, the volume fraction of martensite has an upper limit of 35%; the volume fraction of ferrite has an upper limit of 30%; and the volume fraction of bainite has an upper limit of 75%. Preferably, in the microstructure of the cold-rolled steel sheet of the present disclosure, the volume fraction of bainite is greater than 35%, and the volume fraction of martensite is greater than 20%. In some embodiments, in the microstructure of the cold-rolled steel sheet of the present disclosure, the volume fraction of bainite is greater than 35%, and the volume fraction of martensite is greater than 15%. Preferably, in the microstructure of the cold-rolled steel sheet of the present disclosure, the volume fraction of martensite is greater than 15% to 35%, more preferably 20-35%; the volume fraction of ferrite is greater than 10% to 30%; and the volume fraction of bainite is greater than 30% to 75%, more preferably 35-75%. The cold-rolled steel sheet of the present disclosure does not contain residual austenite in the microstructure.

The yield strength of the steel sheet of the present disclosure is 600 MPa or more, preferably 650 MPa or more, and more preferably 700 MPa or more. In some embodiments, the yield strength of the steel sheet of the present disclosure is in the range of 600-850 MPa, for example, in the range of 700-850 MPa. The tensile strength of the steel sheet of the present disclosure is 980 MPa or more, preferably 1000 MPa or more, and more preferably 1020 MPa or more. In some embodiments, the tensile strength of the steel sheet of the present disclosure is in the range of 980-1100 MPa, for example, in the range of 1000-1100 MPa. The elongation of the steel sheet of the present disclosure is 11% or more, preferably 11.5%, and more preferably 12.0% or more. The hole expansion rate of the steel sheet of the present disclosure is ≥45%, preferably ≥50%, more preferably ≥55%.

In the compositional design of the steel sheet according to the present disclosure:

C: In the steel sheet according to the present disclosure, the addition of the C element can improve the strength of the steel, and ensure the occurrence of martensitic phase transformation and the generation of nano-precipitates. The C content is selected to be between 0.08% and 0.12%, because if the C content is less than 0.08%, it is impossible to ensure that sufficient bainite and martensite are generated during the annealing process, and it is impossible to ensure that sufficient nano-precipitates are precipitated, whereby affecting the strength of the steel sheet. If the C content is higher than 0.12%, the martensite hardness will be too high, and the grain size will be coarse. This is not conducive to the formability of the steel sheet. It is also not easy to incur the ferrite phase transformation after hot rolling and coiling, and nano-precipitates cannot be generated. Preferably, the C content is 0.08%-0.1% or 0.09-0.11%.

Si: The addition of Si can improve hardenability. In addition, the solid dissolved Si in the steel can affect the interaction of dislocations, increase the work hardening rate, and appropriately increase the elongation, which is beneficial to obtain better formability. The Si content is controlled at Si: 0.1%-1.0%, preferably 0.4%-0.8%.

Mn: The addition of the Mn element is beneficial to improve the hardenability of the steel and effectively increase the strength of the steel sheet. The mass percentage of Mn is selected to be 1.9%-2.6%, because if the mass percentage of Mn is less than 1.9%, the hardenability will be insufficient, and sufficient martensite cannot be produced during the annealing process, whereby the strength of the steel sheet will be insufficient; if the mass percentage of Mn is higher than 2.6%, bainite phase transformation will occur in the hot rolling and coiling process, and interphase nano-precipitates cannot be generated. Therefore, in the present disclosure, the mass percentage of Mn is controlled at Mn: 1.9-2.6%, preferably 2.1%-2.4%.

Cr: Both Mn and Cr are carbide-forming elements (dragging carbon in solid solution) and can be replaced with each other to ensure the steel strength when hardenability is taken into consideration. However, the addition of Cr is more effective in delaying pearlite transformation and shifting the bainite phase transformation zone to the left. In addition, Cr reduces the Ms point to a less degree than Mn. Hence, the addition of a reasonable amount of Cr has a more direct effect in controlling the bainite content to be greater than 30%, and the martensite content to be greater than 20%. Therefore, in the present disclosure, the mass percentage of Cr is controlled at Cr: 0.1-0.55%, preferably 0.2%-0.4%.

Al: The addition of Al has the effect of deoxygenation and grain refinement. Therefore, the mass percentage of Al is controlled at Al: 0.01%-0.05%, preferably 0.015-0.045%.

Mo: Mo is added in an amount of 0.1-0.5%, because Mo is firstly the most important compound element that affects the generation of nano-precipitates. Mo can increase the solid solubility of Ti (C, N) in austenite. Hence, a large amount of Ti remains in solid solution, and then precipitates dispersively during low-temperature transformation, resulting in a higher strengthening effect. Mo carbides precipitate together with Ti carbonitrides at low temperatures to form a fine nano-scale precipitate phase. 0.2%-0.3% is preferred.

Ti: Ti is added in an amount of 0.01-0.1%, because Ti is the main compound element of nano-precipitates. At the same time, Ti also exhibits a strong effect in inhibiting the growth of austenite grains at high temperatures, thereby refining the grains. However, in low-carbon steel, if the amount of carbonitride forming elements such as Nb and Ti is too large, subsequent phase transformation will be affected. Hence, the upper limit of the content of alloying elements needs to be controlled, preferably at Ti: 0.02%-0.05%.

In the technical solution according to the present disclosure, the impurity elements include P, N, and S. The lower the impurity content is controlled, the better the implementation effect. The mass percentage of P is controlled at P≤0.015%. MnS formed with S seriously affects the formability. Therefore, the mass percentage of S is controlled at S≤0.003%. Since N is likely to cause cracks or blisters in the surface of a slab, N≤0.005%.

In the above compositional design, the main stage of the generation of nanoprecipitates lies in the hot rolling process. Only the occurrence of diffusion-type phase transformation—ferrite phase transformation after hot rolling and coiling can ensure generation of a sufficient amount of interphase nanoprecipitates. Hence, the contents of C, Mn, Cr and Mo need to be designed reasonably to ensure, in combination with the reasonable design of the coiling temperature, that the diffusion-type phase transformation—ferrite phase transformation occurs after hot rolling and coiling. If the contents of C, Mn, Cr, and Mo are such that the formula $5\times[C]+0.4\times[Si]+0.1\times([Mn]+[Cr]+[Mo])^2$ is calculated to be greater than 1.8, the ferrite phase transformation occurs at a reduced probability during hot rolling, which is not conducive to the formation of nano-precipitates. Preferably, $1.45 \leq 5\times[C]+0.4\times[Si]+0.1\times([Mn]+[Cr]+[Mo])^2 \leq 1.7$.

At the same time, the final structure of the steel sheet after cold rolling and continuous annealing is ferrite+bainite+martensite. The contents of C, Mn, Cr, and Mo need to be designed reasonably to ensure that the bainite C curve shifts to the left; ensure that the volume fraction of the final bainite is greater than 30%, preferably greater than or equal to 35%; ensure certain hardenability; and ensure that the volume fraction of the final martensite is greater than 15%, preferably greater than or equal to 20%, thereby ensuring that the tensile strength is 980 MPa or higher. If the contents of C, Mn, Cr, and Mo are such that the formula $5\times[C]+0.4\times[Si]+0.1\times([Mn]+[Cr]+[Mo])^2$ is calculated to be less than 1.3, the proportions of bainite and martensite in the final structure are insufficient, not beneficial to obtain the tensile strength of 980 MPa at the end.

Therefore, the contents of C, Mn and Si in the present disclosure need to meet the formula: $1.8 \geq 5\times[C]+0.4\times[Si]+0.1\times([Mn]+[Cr]+[Mo])^2 \geq 1.3$ to ensure that, in the final structure, the volume fraction of bainite is greater than 30%, preferably greater than or equal to 35%; the volume fraction of martensite is greater than 15%, preferably greater than or equal to 20%; and a large number of nano-precipitates are uniformly and dispersively distributed.

In addition, during the production process of the steel sheet of the present disclosure, the greater the Mo content, the greater the influence on the amount of Ti solid dissolved in austenite. Particularly, more Ti(C, N) will be solid dissolved in austenite to be precipitated during phase transformation, and thus there are more nano-scale interphase precipitates. In order to obtain a sufficient amount of uniformly and dispersively distributed nano-scale precipitates required by the final structure of the present disclosure, the contents of Mo and Ti in the present disclosure also need to satisfy the formula: $[Mo] \geq 3\times[Ti]$, preferably, $[Mo]/[Ti] \geq 5$.

The manufacturing method of the low-cost and high-formability 980 MPa grade cold-rolled steel sheet of the present disclosure comprises the following steps:

1) Smelting and casting: smelting and casting the above composition into a blank;
2) Hot rolling: first heating to 1150-1250° C., holding for 0.5 hours or more, hot-rolling at a temperature above Ar3, cooling rapidly at a rate of 30-100° C./s after rolling, and coiling at a temperature: 600-750° C.;
3) Cold rolling: controlling a cold rolling reduction rate at 30-70%, preferably 50-70%;
4) Annealing: in an annealing process, soaking at a soaking temperature of 810-870° C., preferably 830-860° C. for a holding time of 50-100 s; then cooling at a rate of 3-10° C./s to a start temperature of rapid cooling which is 660-730° C.; and then cooling at a rate of 30-200° C./s to 200-460° C. (rapid cooling termination temperature);
5) Over-aging: over-aging at an over-aging temperature of 320-460° C. for an over-aging time of 100-400 s.

Preferably, the manufacturing method of the low-cost and high-formability 980 MPa grade cold-rolled steel sheet of the present disclosure further comprises step 6), i.e. a flattening step. Preferably, if the flattening step is performed, the flattening rate is preferably 0.05-0.3%.

In some embodiments, the soaking temperature in the annealing process is preferably 820-870° C., more preferably 840-860° C.

In the manufacturing method of the steel sheet according to the present disclosure:

In the hot rolling process, the holding time is generally 0.5 hours or more, preferably 0.5-3 hours. In some embodiments, the holding time is 0.8-1.5 hours.

The hot rolling process employs a specific coiling temperature: coiling in the ferrite transformation zone (600-750° C.). Only when the diffusion-type phase transformation—ferrite phase transformation occurs after the hot-rolling and coiling, the interphase precipitation of a sufficient amount of uniformly and dispersively distributed nano-precipitates can be ensured. The temperature of the ferrite phase transformation zone of this composition system is between 600-750° C. If the coiling temperature is lower than 600° C., the system will enter the bainite phase transformation zone, and the generation of a sufficient amount of nano-precipitates cannot be guaranteed.

In the annealing step, the soaking temperature during the annealing is limited to 810-870° C., and the holding time of the soaking is 50-100 s. This is because, at this annealing temperature, not only a tensile strength of 980 MPa can be ensured, but also a sufficient amount of uniform and dispersive nano-precipitates can be maintained. If the soaking temperature during the annealing is lower than 810° C. or the holding time of the soaking is shorter than 50 s, an insufficient proportion of the material will be austenitized, so that a sufficient amount of martensite cannot be generated in the final structure, and thus the tensile strength of 980 MPa cannot be guaranteed. If the soaking temperature during the annealing is higher than 870° C. or the holding time of the soaking is longer than 100 s, the nano-precipitates generated after the hot rolling and coiling will grow up and be solid dissolved into austenite again. In this case, it is impossible to ensure that a sufficient amount of nano-precipitates remain in the final structure, or to ensure the effect of precipitation strengthening or the effect in increasing the hole expansion rate. In some embodiments, the holding time of the soaking is 50-90 s.

In the annealing step, the start temperature of the rapid cooling is 660-730° C. The slow cooling process is related with the amount of ferrite generated during the continuous annealing process. If the start temperature of the rapid cooling is lower than 660° C., ferrite will be generated in an amount that is too high to guarantee the minimum contents of bainite and martensite. If the start temperature of the rapid cooling is higher than 730° C., generation of a sufficient amount of ferrite cannot be ensured, so that it cannot be ensured that a high elongation rate will be obtained in the end. Diffusion-type phase transformation—ferrite phase transformation occurs during the slow cooling process, so there will be secondary precipitation of nano-precipitates to ensure that the final ferrite structure contains nano-precipitates that are precipitated in twice to reduce the strength difference from the bainite and martensite phases. In some embodiments, the termination temperature of the rapid cooling is 200-400° C. In some embodiments, the termination temperature of the rapid cooling is 320-460° C.

In the over-aging step, the over-aging temperature is 320-460° C. Only within this temperature range, it can be ensured that the final structure contains 30% or more bainite.

Compared with the prior art, the technical route adopted by the present disclosure is to obtain a final structure of ferrite+bainite+martensite, and the final structure contains fine and dispersive nano-precipitates, so as to obtain a high hole expansion rate and a relatively high elongation.

The inclusion of bainite in the present disclosure can reduce the interphase strength difference of the dual-phase structure of the prototype dual-phase steel ferrite+martensite and increase the hole expansion rate. The sacrificed tensile strength is compensated by the precipitation strengthening effect of the nano-precipitates. The final ferrite structure contains nano-precipitates which strengthen the ferrite structure in the final matrix, thereby reducing the strength difference between the ferrite structure and the bainite and martensite structures in the matrix, leading to a high hole expansion rate in the end.

In addition, the martensite and the fine dispersive nano-precipitates in the structure can ensure the higher strength of the material, and the ferrite structure and the refined grains can ensure the higher elongation. The overall properties of the material are excellent.

The steel sheet structure of the present disclosure comprises 10% or more ferrite+30% or more bainite+15% or more martensite+uniformly and dispersively distributed nano-precipitates having an average diameter of less than 20 nm, so that the hole expansion rate is excellent while the high strength is guaranteed. The yield strength is greater than 600 MPa, the tensile strength is greater than 980 MPa, the elongation is greater than 11%, and the hole expansion rate is ≥45%. The hole expansion rate is high, and the elongation rate is good.

DETAILED DESCRIPTION OF THE INVENTION

The present disclosure will be further explained and illustrated with reference to the following specific examples. Nonetheless, the explanation and illustration are not intended to unduly limit the technical solution of the present disclosure.

The compositions of the steel examples of the present disclosure are shown in Table 1, and the balance of the compositions is Fe. Table 2 lists the process parameters of the steel sheets of the examples. The tensile test was performed in accordance with the standard ASTM A370-2017 method, and the hole expansion rate test was performed in accordance with the ISO/TS 16630-2017 method. Table 3 lists the relevant process parameters of the steel sheets of the examples.

The method for manufacturing the steel examples of the present disclosure is as follows:

(1) Smelting and casting: the required alloy components were obtained, and the contents of S and P were minimized;

(2) Hot rolling: heating was conducted first to 1150-1250° C. which was held for 0.5 hours or more; then hot-rolling at a temperature above Ar3 was conducted; after the rolling, rapid cooling was conducted at a rate of 30-100° C./s; and coiling was conducted at a temperature of 600-750° C. in the hot rolling process;

(3) Cold rolling: the cold rolling reduction rate was controlled at 30-70%;

(4) Annealing: the soaking temperature in the annealing process was 810-870° C., preferably 830-860° C.; the holding time of the soaking was 50-100 s; then cooling was conducted at a rate of v1=3-10° C./s to a starting temperature of rapid cooling which was 660-730° C.; and then cooling was further conducted at a rate of v2=30-200° C./s to 200-460° C.;

(5) Over-aging: the over-aging temperature was 320-460° C., and the over-aging time was 100-400 s.

Optionally, the manufacturing method in each example further comprised step (6) flattening, wherein a flattening rate of 0.05-0.3% was employed.

Table 3 shows the mechanical properties of the cold-rolled steel sheets of Examples 1-12 obtained using the composition and process of the present disclosure: the yield strength is greater than 600 MPa; the tensile strength is greater than 980 MPa; the elongation is greater than 11%; and the hole expansion rate is ≥45%.

This demonstrates that the 980 MPa grade cold-rolled steel sheet of the present disclosure has a tensile strength greater than 980 MPa and has an excellent hole expansion rate.

TABLE 1

(unit: weight %)

| No. | C | Si | Mn | Al | P | S | N | Cr | Mo | Ti |
|---|---|---|---|---|---|---|---|---|---|---|
| Ex. 1 | 0.107 | 0.52 | 2.19 | 0.024 | 0.012 | 0.0023 | 0.0025 | 0.33 | 0.22 | 0.026 |
| Ex. 2 | 0.108 | 0.54 | 2.23 | 0.025 | 0.013 | 0.0022 | 0.0024 | 0.34 | 0.21 | 0.028 |
| Ex. 3 | 0.108 | 0.53 | 2.22 | 0.022 | 0.012 | 0.0021 | 0.0025 | 0.31 | 0.25 | 0.027 |
| Ex. 4 | 0.095 | 0.90 | 2.33 | 0.022 | 0.009 | 0.0021 | 0.0042 | 0.24 | 0.21 | 0.035 |
| Ex. 5 | 0.097 | 0.91 | 2.34 | 0.025 | 0.008 | 0.0024 | 0.0041 | 0.21 | 0.20 | 0.039 |
| Ex. 6 | 0.099 | 0.92 | 2.32 | 0.027 | 0.009 | 0.0024 | 0.0042 | 0.21 | 0.19 | 0.038 |
| Ex. 7 | 0.113 | 0.86 | 2.25 | 0.035 | 0.012 | 0.0018 | 0.0021 | 0.13 | 0.31 | 0.019 |
| Ex. 8 | 0.114 | 0.87 | 2.26 | 0.035 | 0.012 | 0.0014 | 0.0022 | 0.14 | 0.33 | 0.018 |
| Ex. 9 | 0.111 | 0.88 | 2.23 | 0.037 | 0.009 | 0.0010 | 0.0022 | 0.14 | 0.32 | 0.017 |
| Ex. 10 | 0.088 | 0.55 | 2.29 | 0.031 | 0.013 | 0.0015 | 0.0031 | 0.51 | 0.28 | 0.025 |
| Ex. 11 | 0.089 | 0.55 | 2.28 | 0.029 | 0.014 | 0.0016 | 0.0030 | 0.49 | 0.31 | 0.026 |
| Ex. 12 | 0.087 | 0.57 | 2.27 | 0.028 | 0.013 | 0.0017 | 0.0031 | 0.50 | 0.31 | 0.025 |
| Ex. 13 | 0.098 | 0.46 | 2.03 | 0.022 | 0.013 | 0.0022 | 0.0024 | 0.34 | 0.21 | 0.068 |
| Ex. 14 | 0.103 | 0.37 | 2.57 | 0.028 | 0.013 | 0.0017 | 0.0031 | 0.32 | 0.45 | 0.045 |
| Ex. 15 | 0.118 | 0.66 | 1.92 | 0.025 | 0.012 | 0.0018 | 0.0021 | 0.13 | 0.47 | 0.011 |
| Ex. 16 | 0.083 | 0.12 | 2.39 | 0.043 | 0.013 | 0.0015 | 0.0031 | 0.54 | 0.31 | 0.097 |
| Ex. 17 | 0.095 | 0.97 | 2.23 | 0.048 | 0.009 | 0.0021 | 0.0042 | 0.27 | 0.41 | 0.048 |
| Ex. 18 | 0.107 | 0.32 | 2.19 | 0.011 | 0.012 | 0.0023 | 0.0025 | 0.48 | 0.18 | 0.056 |

TABLE 2

| No. | Hot Rolling | | | | | Cold Rolling | Annealing | |
|---|---|---|---|---|---|---|---|---|
| | Heating Temperature ° C. | Holding Time h | Hot rolling temperature ° C. | Cooling Rate ° C./s | Coiling Temperature ° C. | Cold Rolling Reduction Rate % | Annealing Temperature ° C. | Soaking Time s |
| Ex. 1 | 1150 | 0.8 | 880 | 50 | 630 | 50 | 830 | 90 |
| Ex. 2 | 1150 | 0.8 | 880 | 50 | 630 | 50 | 850 | 90 |
| Ex. 3 | 1150 | 0.8 | 880 | 50 | 630 | 50 | 870 | 90 |
| Ex. 4 | 1200 | 1 | 890 | 60 | 660 | 60 | 830 | 80 |
| Ex. 5 | 1200 | 1 | 890 | 60 | 660 | 60 | 850 | 80 |
| Ex. 6 | 1200 | 1 | 890 | 60 | 660 | 60 | 870 | 80 |
| Ex. 7 | 1230 | 1.2 | 900 | 70 | 690 | 55 | 830 | 70 |
| Ex. 8 | 1230 | 1.2 | 900 | 70 | 690 | 55 | 850 | 70 |
| Ex. 9 | 1230 | 1.2 | 900 | 70 | 690 | 55 | 870 | 70 |
| Ex. 10 | 1250 | 1.5 | 910 | 50 | 720 | 60 | 830 | 60 |
| Ex. 11 | 1250 | 1.5 | 910 | 50 | 720 | 60 | 850 | 60 |
| Ex. 12 | 1250 | 1.5 | 910 | 50 | 720 | 60 | 870 | 60 |
| Ex. 13 | 1150 | 0.8 | 880 | 30 | 600 | 30 | 850 | 90 |
| Ex. 14 | 1250 | 1.5 | 910 | 50 | 720 | 60 | 870 | 60 |
| Ex. 15 | 1230 | 1.2 | 900 | 70 | 690 | 55 | 830 | 70 |
| Ex. 16 | 1250 | 1.5 | 910 | 50 | 750 | 70 | 810 | 50 |
| Ex. 17 | 1200 | 1 | 890 | 60 | 660 | 100 | 830 | 80 |
| Ex. 18 | 1150 | 0.8 | 880 | 100 | 630 | 50 | 830 | 100 |

| No. | Annealing | | | | | | |
|---|---|---|---|---|---|---|---|
| | Fast Cooling | | | Fast Cooling | Over-aging | | |
| | Cooling Rate v1 ° C./s | Start Temperature (° C.) | Fast Cooling Rate v2 ° C./s | Termination Temperature ° C. | Over-aging Temperature ° C. | Over-aging Time s | Flattening Flattening Rate % |
| Ex. 1 | 3 | 670 | 60 | 370 | 370 | 180 | 0.05 |
| Ex. 2 | 3 | 670 | 60 | 370 | 370 | 180 | 0.10 |
| Ex. 3 | 3 | 670 | 60 | 370 | 370 | 180 | 0.15 |
| Ex. 4 | 5 | 690 | 70 | 380 | 380 | 220 | 0.20 |
| Ex. 5 | 5 | 690 | 70 | 380 | 380 | 220 | 0.25 |
| Ex. 6 | 5 | 690 | 70 | 380 | 380 | 220 | 0.30 |
| Ex. 7 | 6 | 700 | 80 | 390 | 390 | 250 | 0.08 |
| Ex. 8 | 6 | 700 | 80 | 390 | 390 | 250 | / |
| Ex. 9 | 6 | 700 | 80 | 390 | 390 | 250 | / |
| Ex. 10 | 8 | 680 | 90 | 400 | 400 | 270 | 0.22 |
| Ex. 11 | 8 | 680 | 90 | 400 | 400 | 270 | 0.17 |
| Ex. 12 | 8 | 680 | 90 | 400 | 400 | 270 | 0.12 |
| Ex. 13 | 3 | 660 | 30 | 200 | 460 | 180 | 0.08 |
| Ex. 14 | 10 | 680 | 90 | 280 | 400 | 270 | 0.12 |
| Ex. 15 | 6 | 700 | 80 | 320 | 320 | 400 | 0.25 |
| Ex. 16 | 8 | 730 | 200 | 400 | 400 | 100 | 0.21 |
| Ex. 17 | 5 | 690 | 70 | 460 | 460 | 220 | 0.18 |
| Ex. 18 | 3 | 670 | 160 | 370 | 370 | 330 | 0.09 |

Note:
"/" indicates not flattened.

TABLE 3

| No. | Yield Strength (MPa) | Tensile Strength (MPa) | Elongation (%) | Hole Expansion Rate (%) |
|---|---|---|---|---|
| Ex. 1 | 664 | 1040 | 12.3 | 47 |
| Ex. 2 | 675 | 1018 | 11.8 | 51 |
| Ex. 3 | 685 | 1027 | 11.9 | 50 |
| Ex. 4 | 730 | 1096 | 12.2 | 52 |
| Ex. 5 | 743 | 1108 | 12.1 | 54 |
| Ex. 6 | 741 | 1087 | 12.3 | 54 |
| Ex. 7 | 779 | 1024 | 11.4 | 60 |
| Ex. 8 | 786 | 1024 | 11.6 | 58 |
| Ex. 9 | 776 | 1019 | 11.5 | 61 |
| Ex. 10 | 719 | 1038 | 12.4 | 47 |
| Ex. 11 | 709 | 1028 | 12.1 | 51 |
| Ex. 12 | 731 | 1017 | 11.8 | 52 |
| Ex. 13 | 710 | 1029 | 13.4 | 49 |
| Ex. 14 | 689 | 1019 | 12.9 | 50 |
| Ex. 15 | 821 | 1045 | 11.9 | 56 |

TABLE 3-continued

| No. | Yield Strength (MPa) | Tensile Strength (MPa) | Elongation (%) | Hole Expansion Rate (%) |
|---|---|---|---|---|
| Ex. 16 | 798 | 1098 | 11.4 | 67 |
| Ex. 17 | 816 | 1087 | 12.1 | 67 |
| Ex. 18 | 765 | 1076 | 11.9 | 49 |

We claim:

1. A 980 MPa grade cold-rolled steel sheet having a high hole expansion rate and a high elongation, wherein the steel sheet has a chemical composition based on mass percentage of: C: 0.08%-0.12%, Si: 0.1%-1.0%, Mn: 1.9%-2.6%, Al: 0.01%-0.05%, Cr: 0.1-0.55%, Mo: 0.18-0.5%, Ti: 0.01-0.1%, and a balance of Fe and unavoidable impurities, wherein the following relationships are satisfied: $1.8 \geq 5 \times [C]+0.4 \times [Si]+0.1 \times ([Mn]+[Cr]+[Mo])^2 > 1.3$, $[Mo] \geq 3 \times [Ti]$, wherein the cold-rolled steel sheet has a microstructure of ferrite+bainite+martensite, wherein ferrite has a volume fraction of greater than 10%; bainite has a volume fraction of greater than 30%; martensite has a volume fraction of greater than 15%; wherein the microstructure further comprises uniformly and dispersively distributed nano-scale precipitates having an average size of less than 20 nm, and wherein the cold-rolled steel sheet has a yield strength of greater than 600 MPa, a tensile strength of greater than 980 MPa, an elongation of greater than 11%, and a hole expansion rate of ≥45%.

2. The 980 MPa grade cold-rolled steel sheet having a high hole expansion rate and a high elongation according to claim 1, wherein the C content is 0.09%-0.11%.

3. The 980 MPa grade cold-rolled steel sheet having a high hole expansion rate and a high elongation according to claim 1, wherein the Si content is 0.4%-0.8%.

4. The 980 MPa grade cold-rolled steel sheet having a high hole expansion rate and a high elongation according to claim 1, wherein the Mn content is 2.1%-2.4%.

5. The 980 MPa grade cold-rolled steel sheet having a high hole expansion rate and a high elongation according to claim 1, wherein the Al content is 0.015%-0.045%.

6. The 980 MPa grade cold-rolled steel sheet having a high hole expansion rate and a high elongation according to claim 1, wherein the Cr content is 0.2%-0.4%.

7. The 980 MPa grade cold-rolled steel sheet having a high hole expansion rate and a high elongation according to claim 1, wherein the Mo content is 0.2%-0.3%.

8. The 980 MPa grade cold-rolled steel sheet having a high hole expansion rate and a high elongation according to claim 1, wherein the Ti content is 0.02%-0.05%.

9. The 980 MPa grade cold-rolled steel sheet having a high hole expansion rate and a high elongation according to claim 1, wherein $1.45 \leq 5\times[C]+0.4\times[Si]+0.1\times([Mn]+[Cr]+[Mo])^2 \leq 1.7$.

10. The 980 MPa grade cold-rolled steel sheet having a high hole expansion rate and a high elongation according to claim 1, wherein the microstructure of the cold-rolled steel sheet is ferrite+bainite+martensite, wherein ferrite has a volume fraction of greater than 10% to 30%; bainite has a volume fraction of 35-75%; and martensite has a volume fraction of greater than 15% to 35%.

11. A manufacturing method for the 980MPa grade cold-rolled steel sheet having a high hole expansion rate and a high elongation according to claim 1, wherein the method comprises the following steps:

1) smelting and casting the chemical composition in claim 1 into a blank;
2) first heating to 1150-1250° C., holding for 0.5 hours or more, hot-rolling at a temperature above Ar3, cooling rapidly at a rate of 30-100° C./s after rolling, and coiling at a temperature: 600-750° C.;
3) controlling a cold rolling reduction rate at 30-70%;
4) in an annealing process, soaking at a soaking temperature of 810-870° C. for a holding time of 50-100s; then cooling at a rate of 3-10° C./s to a start temperature of rapid cooling which is 660-730° C.; and then cooling at a rate of 30-200° C./s to 200-460° C.; and
5) over-aging at an over-aging temperature of 320-460° C. for an over-aging time of 100-400s.

12. The manufacturing method for the 980MPa grade cold-rolled steel sheet having a high hole expansion rate and a high elongation according to claim 11, further comprising step 6) flattening, wherein a flattening rate of 0.05-0.3% is used.

13. The manufacturing method for the 980MPa grade cold-rolled steel sheet having a high hole expansion rate and a high elongation according to claim 11, wherein in step 2), the holding time is 0.5-3 hours;

in step 3), the cold rolling reduction rate is controlled at 50-70%;

in step 4), an annealing temperature is 820-870° C.; the holding time of the soaking is 50-90 s; and the cooling is conducted at a cooling rate of 50-200° C./s to 320-460° C.

14. The 980 MPa grade cold-rolled steel sheet having a high hole expansion rate and a high elongation according to claim 1, wherein:

the C content of the 980 MPa grade cold-rolled steel sheet is 0.09%-0.11%;

the Si content of the 980 MPa grade cold-rolled steel sheet is 0.4%-0.8%;

the Mn content of the 980 MPa grade cold-rolled steel sheet is 2.1%-2.4%;

the Al content of the 980 MPa grade cold-rolled steel sheet is 0.015%-0.045%;

the Cr content of the 980 MPa grade cold-rolled steel sheet is 0.2%-0.4%;

the Mo content of the 980 MPa grade cold-rolled steel sheet is 0.2%-0.3%; and the Ti content of the 980 MPa grade cold-rolled steel sheet is 0.02%-0.05%.

15. The manufacturing method for the 980MPa grade cold-rolled steel sheet having a high hole expansion rate and a high elongation according to claim 11, wherein:

the C content of the 980MPa grade cold-rolled steel sheet is 0.09%- 0.11%;

the Si content of the 980MPa grade cold-rolled steel sheet is 0.4%- 0.8%;

the Mn content of the 980MPa grade cold-rolled steel sheet is 2.1%- 2.4%;

the Al content of the 980MPa grade cold-rolled steel sheet is 0.015%- 0.045%;

the Cr content of the 980MPa grade cold-rolled steel sheet is 0.2%- 0.4%;

the Mo content of the 980MPa grade cold-rolled steel sheet is 0.2%- 0.3%; and/or the Ti content of the 980MPa grade cold-rolled steel sheet is 0.02%- 0.05%.

16. The manufacturing method for the 980MPa grade cold-rolled steel sheet having a high hole expansion rate and a high elongation according to claim 11, wherein the contents of C, Si, Mn, Cr and Mo of the 980MPa grade cold-rolled steel shee satisfies: $1.45 \leq 5\times [C] +0.4\times [Si] +0.1 \times ([Mn] + [Cr] + [Mo])^2 \leq 1.7$.

* * * * *